US005521563A

United States Patent [19]

Mazzochette

[11] Patent Number: 5,521,563

[45] Date of Patent: May 28, 1996

[54] MICROWAVE HYBRID COUPLER

[75] Inventor: Joseph B. Mazzochette, Cherry Hill, N.J.

[73] Assignee: EMC Technology, Inc., Cherry Hill, N.J.

[21] Appl. No.: 462,188

[22] Filed: Jun. 5, 1995

[51] Int. Cl.[6] ..... H01P 5/18

[52] U.S. Cl. ..... 333/116; 333/246

[58] Field of Search ..... 333/116, 238, 333/246

[56] References Cited

U.S. PATENT DOCUMENTS

| | | | |
|---|---|---|---|
| 3,617,952 | 11/1971 | Beech | 333/116 |
| 4,375,054 | 2/1983 | Pavio | 333/116 |
| 4,902,990 | 2/1990 | Cicso | 333/116 |
| 5,063,365 | 11/1991 | Cappucci | 333/116 X |
| 5,159,298 | 10/1992 | Dydyk | 333/116 X |
| 5,243,305 | 9/1993 | D'Oro et al. | 333/116 |
| 5,369,379 | 11/1994 | Fujiki | 333/116 |

FOREIGN PATENT DOCUMENTS

| | | |
|---|---|---|
| 51445 | 4/1979 | Japan . |
| 027987 | 6/1987 | U.S.S.R. . |

*Primary Examiner*—Paul Gensler
*Attorney, Agent, or Firm*—Donald S. Cohen

[57] ABSTRACT

A hybrid coupler which includes a substrate of an insulating material having a pair of opposed surfaces. A conductive ground plane is on one of the substrate surfaces. A pair of conductive transmission lines are over the other substrate surface and a layer of a dielectric material is over the other substrate surface. Each of the transmission lines has one portion which is on the substrate surface and under the dielectric layer, another portion which is over the dielectric layer and a connecting portion which electrically connects the two portions of the transmission line. Each of the connecting portion extends through an opening in the dielectric layer and one of the connecting portions crosses over the other connecting portion. The portions of the transmission lines may extend in straight lines, in a serpentine path or in a rectangular path. The portions of the transmission lines have ports at one end with the ports of the one portions of the lines being adjacent the same edge of the substrate, and the ports of the other portions of the lines being adjacent the same edge of the substrate.

16 Claims, 3 Drawing Sheets

MICROWAVE HYBRID COUPLER

FIELD OF THE INVENTION

The present invention is directed to a microwave hybrid coupler, and, more particularly, to a hybrid coupler in which transit time through the lines of the coupler are equalized.

BACKGROUND OF THE INVENTION

A hybrid coupler, in general, comprises a pair of conductive transmission lines which have portions which are generally parallel with a separate port at each end of each line. One such coupler is shown in U.S. Pat. No. 5,159,298 to M. Dydyk, issued Oct. 27, 1992 and entitled "Microstrip Directional Coupler With Single Element Compensation". In order to provide the outlet ports of each line on the same side of the device, a hybrid coupler has been developed in which the two lines cross-over each other. One such a device is shown in U.S. Pat. No. 4,902,990 to T. C. Cicso, issued Feb. 20, 1990 and entitled "Thick Film Microwave Coupler". In the coupler of Cicso, a first conductive transmission line is formed on a surface of an insulating substrate. A layer of a dielectric material is coated over the first transmission line. A second conductive transmission line is formed on the dielectric layer. A problem with this structure is that the first transmission line has dielectric material on both sides thereof, whereas the second transmission line has dielectric material on only one side thereof. This results in the transit time for each of the lines being different. Therefore, it would be desirable to have such a coupler in which the transit time of the two lines is substantially equal. Another problem with the Cicso hybrid coupler results from the fact that the port-to-port coupling will vary with the distance between the two conductive lines. This distance may vary because the two lines are not printed at the same time. Therefore, it would be desirable to have a hybrid coupler in which the problem caused by variations in the distance between the two lines is compensated for.

SUMMARY OF THE INVENTION

The present invention is directed to a hybrid coupler which includes a substrate of an insulating material having a surface. A pair of conductive transmission lines are over the surface of the substrate. A layer of a dielectric material is over the surface of the substrate. Each of the lines has a first portion which is between the dielectric layer and the substrate surface, a second portion which is over the dielectric layer and a connecting portion connecting the first and second portions. The transmission lines may be in non-straight relation, rectangular or serpentine layout.

DETAILED DESCRIPTION

Figure 1:
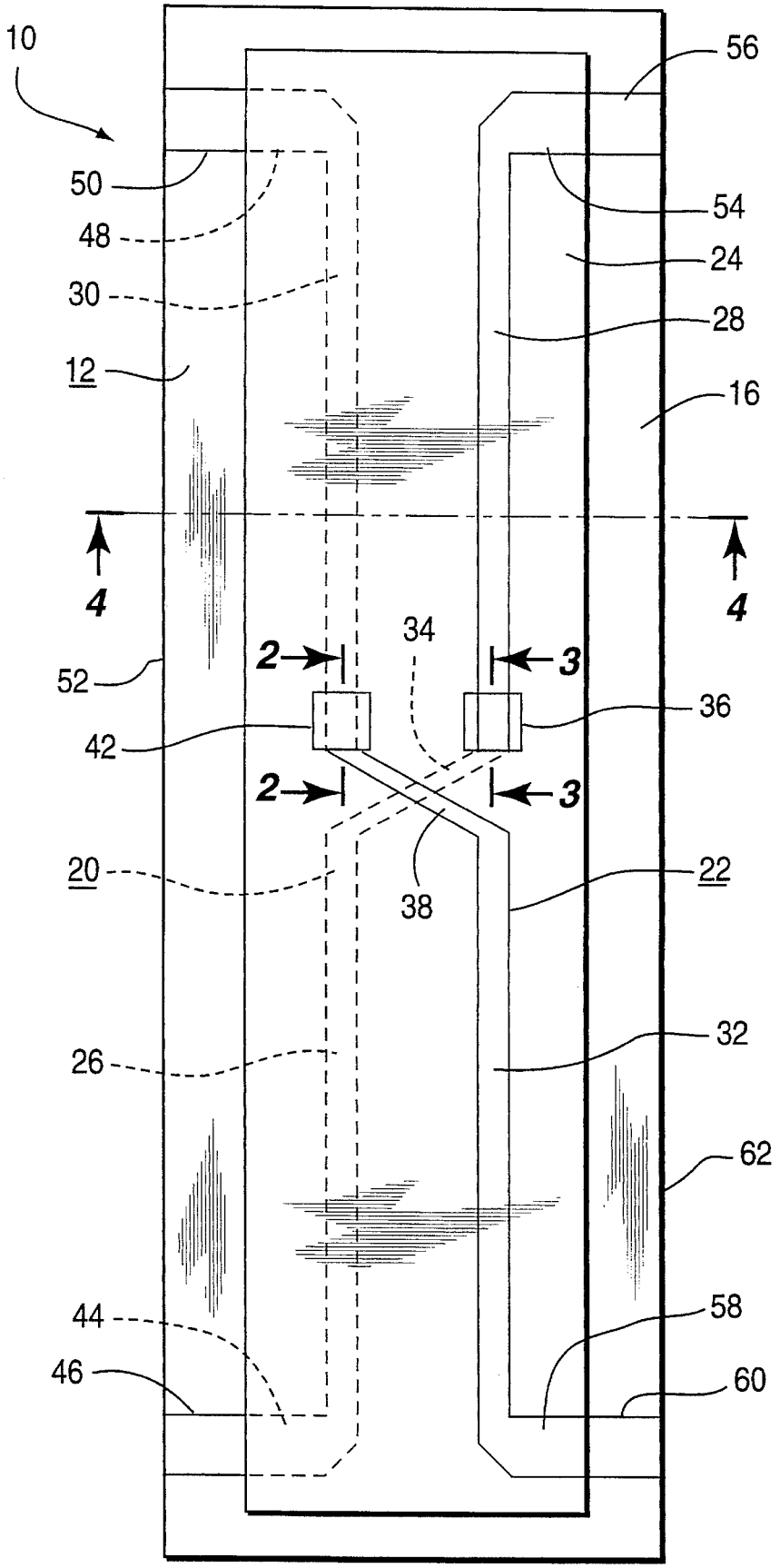
FIG. 1 is a top plan view of one form of the hybrid coupler of the present invention.
Figure 2:
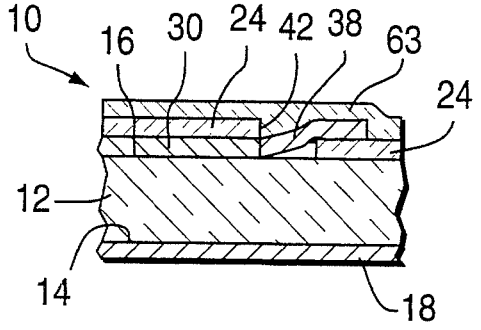
FIG. 2 is a sectional view taken along line 2—2 of FIG. 1.
Figure 3:
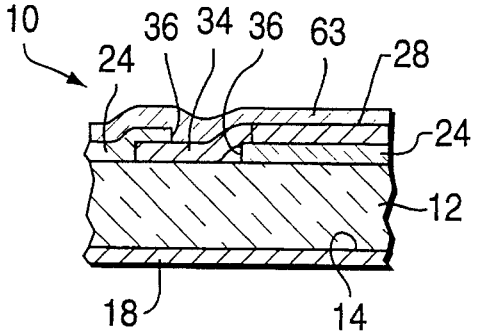
FIG. 3 is a sectional view taken along line 3—3 of FIG. 1.
Figure 4:
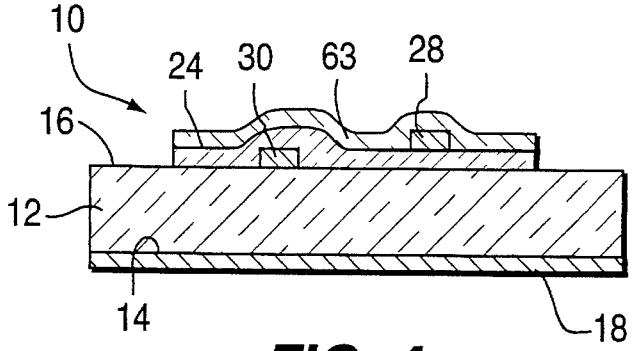
FIG. 4 is a sectional view taken along line 4—4 of FIG. 1.

Referring initially to FIGS. 1–4, one form of the hybrid coupler of the present invention is generally designated as 10. Hybrid coupler 10 comprises a substrate 12 of an insulating material, such as alumina, having a pair of opposed flat surfaces 14 and 16 (see FIGS. 2–4). On the surface 14 is a ground layer 18 of a conductive material, such as a metal. Over the surface 16 is a first transmission line 20, a second transmission line 22 and a dielectric layer 24. The transmission lines 20 and 22 are each of a conductive material, such as a metal.

The first transmission line 20 has a first straight portion 26 which is directly on the surface 16 and under the dielectric layer 24, and a second straight portion 28 which is over and on the dielectric layer 24. The first and second portions 26 and 28 of the first transmission line 20 are parallel, but spaced from each other laterally and longitudinally. The second transmission line 22 has a first straight portion 30 which is directly on the surface 16 of the substrate 12 and under the dielectric layer 24, and a second straight portion 32 which is over and on the dielectric layer 24. The first and second portion 30 and 32 of the second transmission line are parallel, but spaced from each other laterally and longitudinally. The first portion 26 of the first transmission line 20 and the first portion 30 of the second transmission line 22 are in alignment., but are longitudinally spaced apart. The second portion 28 of the first transmission line 20 and the second portion 32 of the second transmission line 22 are in alignment, but longitudinally spaced apart.

A first connecting portion 34 is on the surface 16 of the substrate 12 and extends from the end of the first portion 26 of the first transmission line 20 which is adjacent the first portion 30 of the second transmission line 22 to the adjacent end of the second portion 28 of the first transmission line 20. The connecting portion 34 then extends through an opening 36 in the dielectric layer 24 to the end of the second portion 28 of the first transmission line 20 (see FIG. 3). Thus, the first portion 26 of the first transmission line 20 is electrically connected to the second portion 28 of the first transmission line 20 through the connection portion 34.

A second connecting portion 38 is on the dielectric layer 24 and extends from the end of the second portion 32 of the second transmission line 22 which is adjacent the second portion 28 of the first transmission line 20 toward the adjacent end of the first portion 30 of the second transmission line 22. The second connecting portion 38 extends across, i.e. crosses over, the first connecting portion 34. The second connection portion 38 then extends through an opening 42 in the dielectric layer 24 to the end of the first portion 30 of the second transmission line 22. Thus, the first portion 30 of the second transmission line 22 is electrically connected to the second portion 32 of the second transmission line 22 through the second connecting portion 38.

A first inlet port 44 is on the surface 16 of the substrate 12 and extends from the end of the first portion 26 of the first transmission line 20 to a terminal pad 46 on the surface 16. A second inlet port 48 is on the surface 16 of the substrate 12 and extends from the end of the first portion 30 of the second transmission line 22 to a terminal pad 50 on the surface 16 of the substrate 12. The first and second inlet ports 44 and 48 are adjacent the same side edge 52 of the substrate 12. A first outlet port 54 is on the dielectric layer 24 and extends from the end of the second portion 28 of the first transmission line 20 to a terminal pad 56 on the surface 16 of the substrate 12. A second outlet port 58 is on the dielectric layer 24 and extends from the end of the second portion 32 of the second transmission line 22 to a terminal pad 60 on the surface 16 of the substrate 12. The first and second outlet ports 54 and 58 are adjacent the same side edge 62 of the substrate 12. A protection layer 63 of an insulating material is over the dielectric layer 24 and the second portions 28 and 32 of the first and second transmission lines 20 and 22 to protect them from abrasion and oxidation.

Thus, it can be seen that the hybrid coupler 10 has a pair of transmission lines each of which is divided into two portions with one portion of each line being along a different side edge of the substrate. Thus, a first portion of each transmission line is in alignment along one side edge of the substrate and a second portion of each transmission line is in alignment along a second side edge of the substrate. This provides for the inlet ports of each of the transmission lines being at the same side edge of the substrate and the outlet ports of each transmission line being at the same side edge of the substrate for ease of electrically connecting the hybrid coupler 10 to other electrical components with which the coupler is to be used. However, in the hybrid coupler 10 of the present invention, one portion of each of the transmission lines is between the substrate and the dielectric layer and a second portion of each of the transmission lines is only over the dielectric layer. Thus, each of the transmission lines is in contact with the same amount of the dielectric material of the substrate and the dielectric layer so that the transit times of the two lines is substantially equal.

Figure 5:
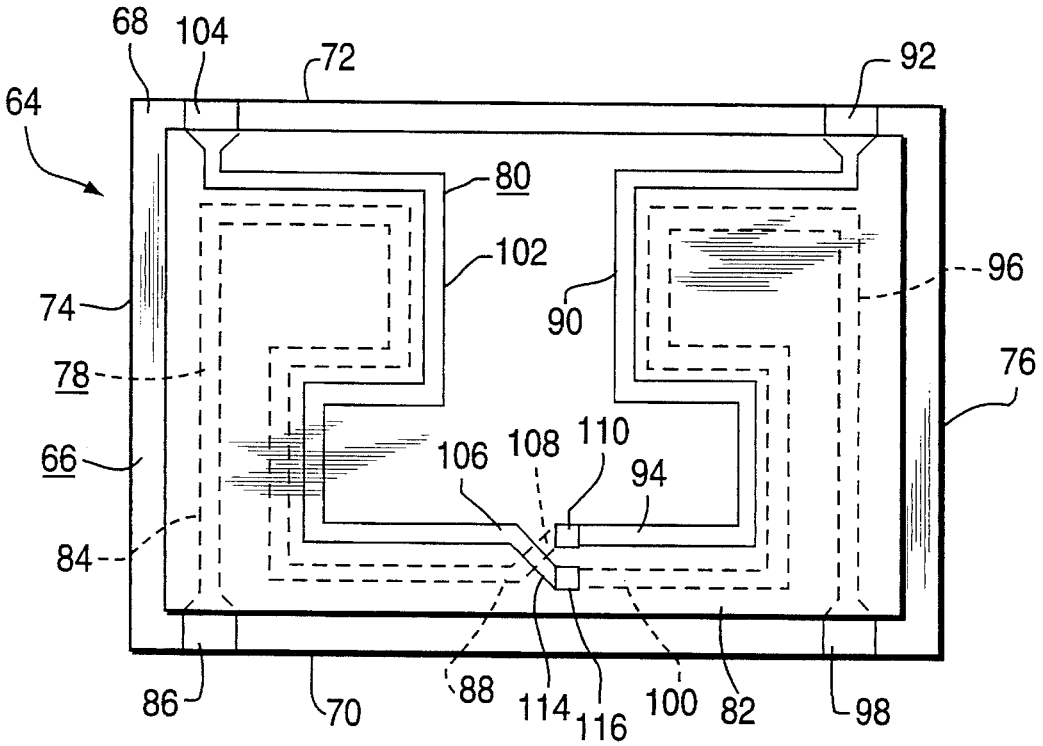
FIG. 5 is a top plan view of a second form of the hybrid coupler of the present invention.

Referring now to FIG. 5, a second form of the hybrid coupler of the present invention is generally designated as 64. Hybrid coupler 64 comprises a substrate 66 of an insulating material having a surface 68, side edges 70 and 72 and end edges 74 and 76. The substrate 66 also has a surface opposite the surface 68 on which is a ground plane layer, not shown, such as in the hybrid coupler 10 shown in FIGS. 1–4. Over the surface 68 are first and second transmission lines 78 and 80 and a dielectric layer 82. The transmission lines 78 and 80 are of a conductive material, such as a metal.

The first transmission line 78 has a first portion 84 which is on the surface 68 of the substrate 66 and under the dielectric layer 82. The first portion 84 of the first transmission line 78 starts adjacent the end edge 74 of the substrate 66 and has a port end 86 adjacent one side edge 70 of the substrate 66. The first portion 84 of the first transmission line 78 extends in a serpentine path transversely across the surface 68 substantially parallel to the end edge 74, then longitudinally along the substrate surface 68 toward the other end edge 76 partially along the substrate surface 68, then transversely back along the substrate surface toward the side edge 70, then back toward the end edge 74, then transversely back toward the side edge 70 and then longitudinally along a portion of the substrate surface 68 toward the end edge 76 to a second end 88 of the first portion 84.

The first transmission line 78 has a second portion 90 which is on the dielectric layer 82. The second portion 90 also extends along a serpentine path starting at a port end 92 which is adjacent the side edge 72 and the end edge 76. The second portion 90 extends from the port end 92 longitudinally along a portion of the substrate surface 68 substantially parallel to the side edge 72, then transversely across a portion of the substrate surface 68 toward the other side edge 70, then back toward the end edge 76, then transversely across the substrate surface 68 to the side edge 70 and then longitudinally over the substrate 68 along the side edge 70. The second portion 90 has an end 94 which is adjacent to but laterally spaced from the end 88 of the first portion 84 of the first transmission line 78.

The second transmission line 80 has a first portion 96 which is on the substrate surface 68 and under the dielectric layer 82. The first portion 96 extends along a serpentine path from a port end 98 which is adjacent the end edge 76 and side edge 70 of the substrate 66. The first portion 96 extends transversely across the substrate surface 68 substantially parallel to the end edge 76 to the second portion 90 of the first transmission line 78 and then parallels, but is spaced from, the second portion 90 of the first transmission line 78 to an end 100 which is adjacent but longitudinally spaced from the end 88 of the first portion 84 of the first transmission line 78.

The second transmission line 80 has a second portion 102 which is on the dielectric layer 82 and extends along a serpentine path from a port end 104 which is adjacent the end edge 74 and the side edge 72. The second portion 102 parallels, but is spaced from, the first portion 84 of the first line 78 to an end 106 which is adjacent but laterally spaced from the end 100 of the first portion 96 of the second transmission line 80.

The first transmission line 78 has a connecting portion 108 which extends from the end 88 of the first portion 84 along the substrate surface 68 to an opening 110 in the dielectric layer 82 which is adjacent the end 94 of the second portion 90. The connecting portion 108 then extends through the opening 110 in the dielectric layer 82 to the end 94 of the second portion 90 so as to electrically connect the first and second portions 84 and 90 of the first transmission line 78. The second transmission line 80 has a connecting portion 114 which extends from the end 106 of the second portion 102 of the second transmission line 80 along the dielectric layer 82 to an opening 116 in the dielectric layer 82 adjacent the end 100 of the first portion 96 of the second transmission line 80. The connecting portion 114 extends across, i.e. crosses over, the connecting portion 108 of the first transmission line 78. The connecting portion 114 then extends through the opening 116 in the dielectric layer 82 to the end 100 of the first portion 96 so as to electrically connect the first and second portions 96 and 102 of the second transmission line 80. A protection layer (not shown) of an insulating material is over the dielectric layer 82 and the second portions 90 and 102 of the first and second transmission lines 78 and 80.

In the hybrid coupler 64, the port end 86 of the first portion 84 of the first transmission line 78 and the port end 98 of the first portion 96 of the second transmission line 80 are the inlet ports of the lines and are on the same side edge 70 of the substrate 66. The port end 92 of the second portion 90 of the first transmission line 78 and the port end 104 of the second portion 102 of the second transmission line 80 are the output ports and are on the same side edge 72 of the substrate 66. Thus the input ports and the output ports are along the same side edges of substrate for ease of connecting the hybrid coupler 64 to other components with which the coupler is to be used. Also, each of the transmission lines 78 and 80 has substantially one-half of its length between the substrate surface 68 and the dielectric layer 82 and one-half over the dielectric layer 82. Thus, each line see the same amount of dielectric so that the transit times for the two lines are substantially equal. In addition, the serpentine arrangement of the two transmission lines 78 and 80 provides for equal port-to-port coupling. The port-to-port coupling of the lines will vary with the spacing between the two lines. In making the hybrid coupler, the lines are formed by means of masks. After one line is formed, if the masks used to form the other lines are not absolutely aligned with the first line, there will be variations in the spacing between the lines. However, in the serpentine arrangement, variations along one portion of the lines is compensated for by an opposite variation in another portion of the lines. Thus, the port-to-port coupling is maintained substantially equal for the two lines.

Figure 6:
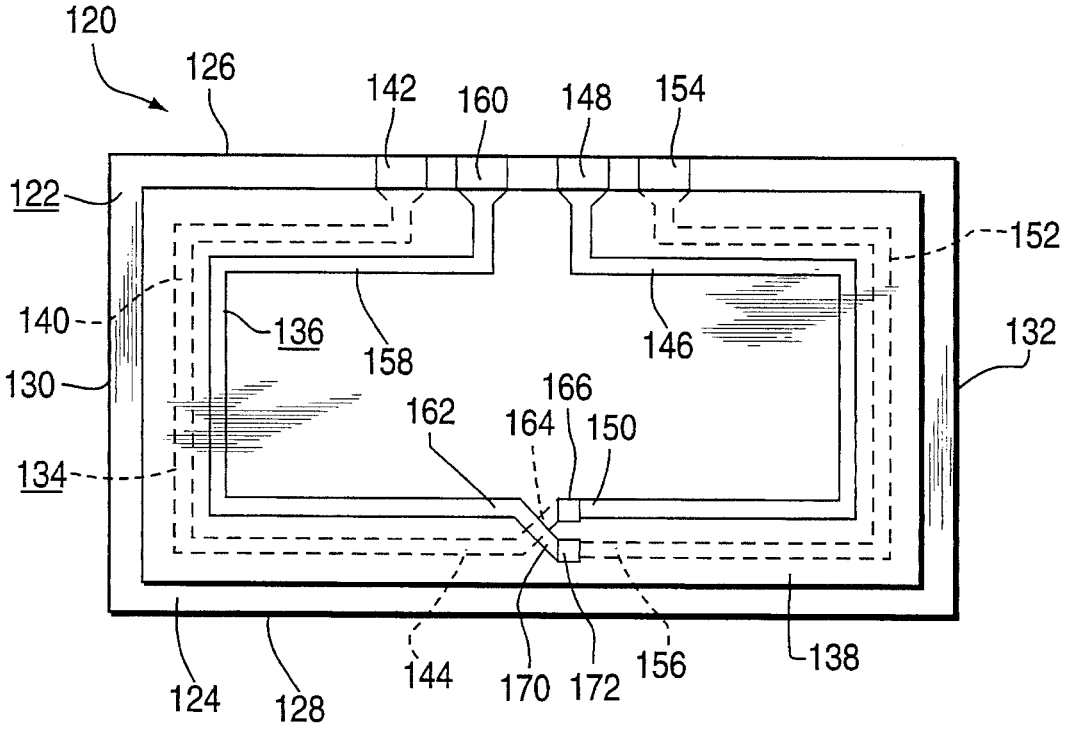
FIG. 6 is a top plan view of a third form of the hybrid coupler of the present invention.

Referring now to FIG. 6, a third form of the hybrid coupler of the present invention is generally designated as 120. Hybrid coupler 120 comprises a substrate 122 of an insulating material, such as alumina, having a surface 124, side edges 126 and 128 and end edges 130 and 132. The substrate 122 also has a surface (not shown) opposite the surface 124 on which is a conductive ground layer (not shown). Over the substrate surface 124 is a first transmission line 134, a second transmission line 136 and a dielectric layer 138. The transmission lines 134 and 136 are of a conductive material, such as a metal.

The first transmission line 134 has a first portion 140 which is on the substrate surface 124 and under the dielectric layer 138. The first portion 140 of the first transmission line 134 has a port end 142 which is adjacent the side edge 126 of the substrate 122 but spaced from the end edge 130. The first portion 140 extends from the port end 142 between the substrate surface 124 and the dielectric layer 138 along the side edge 126 toward the end edge 130, then along the end edge 130 to the side edge 128, and then partially along the side edge 128 to an end 144. The first transmission line 134 has a second portion 146 which is on the dielectric layer 138 the second portion 146 has a port end 148 adjacent the side edge 126 but spaced from the end edge 132. The second portion 146 extends from the port end 148 over the dielectric layer 138 along the side edge 126 toward the end edge 132, then along the end edge 132 to the side edge 128 and then partially along the side edge 128 to an end 150. The end 150 of the second portion 146 of the first transmission line 134 is adjacent to but spaced laterally from the end 144 of the first portion 140 of the first transmission line 134.

The second transmission line 136 has a first portion 152 which is on the substrate surface 124 and under the dielectric layer 138 and has a port end 154 which is adjacent to but spaced from the port end 148 of the second portion 146 of the first transmission line 134. The first portion 152 of the second transmission line 136 extends from its port end 154 over the substrate surface 124 and under the dielectric layer 138 along a path which is parallel to but spaced from the second portion 146 of the first transmission line 134 to an end 156. The end 156 of the first portion 152 of the second transmission line 136 is in alignment with but spaced from the end 144 of the first portion 140 of the first transmission line 134.

The second transmission line 136 has a second portion 158 which is on the dielectric layer 138 and which has a port end 160 adjacent to but spaced from the port end 142 of the first portion 140 of the first transmission line 134. The second portion 158 of the second transmission line 136 extends from its port end 160 over the dielectric layer 138 and along a path which is substantially parallel to the first portion 140 of the first transmission line 134 to an end 162. The end 162 of the second portion 158 of the second transmission line 136 is in alignment with but spaced from the end 150 of the second portion 146 of the first transmission line 134, and adjacent but laterally spaced from the end 156 of the first portion 152 of the second transmission line 136.

A connecting portion 164 extends from the end 144 of the first portion 140 of the first transmission line 134 between the substrate surface 124 and the dielectric layer 138 to an opening 166 in the dielectric layer 138 adjacent the end 150 of the second portion 146 of the first transmission line 134. The connecting portion 164 then extends through the opening 166 in the dielectric layer 138 to the end 150 of the second portion 146 of the first transmission line 134 to electrically connect the first and second portions 140 and 146 of the first transmission line 134. A connecting portion 170 extends from the end 162 of the second portion 158 of the second transmission line 136 over the dielectric layer 138 to an opening 172 in the dielectric layer 138 adjacent the end 156 of the first portion 152 of the second transmission line 136. The connecting portion 170 of the second transmission line 136 extends across, i.e. crosses over, the connecting portion 164 of the first transmission line 134. The connecting portion 170 then extends through the opening 172 in the dielectric layer 138 to the end 156 of the first portion 152 of the second transmission line 136 so as to electrically connect the first and second portions 152 and 158 of the second transmission line 136. A protection layer (not shown) of an insulating layer is provided over the dielectric layer 138 and the second portions 146 and 158 of the first and second transmission lines 134 and 136.

In the hybrid coupler 120, the port end 142 of the first transmission line 134 and the port end 154 of the second transmission line 136 are the inlet ports of the lines and are adjacent each other at the same side edge 126 of the substrate 122. The port end 148 of the first transmission line 134 and the port end 160 of the second transmission line 136 are the outlet ports of the lines and are arranged adjacent each other between the inlet ports 142 and 154 at the same side edge 126 of the substrate 122. Thus, the ports are arranged so that they can be easily connected to other components with which the hybrid coupler 120 is to be used.

The rectangular arrangement of the transmission lines 134 and 136 in the hybrid coupler 120 makes it self compensating for possible mask misalignments in the same manner as the hybrid coupler 64 shown in FIG. 5. The rectangular arrangement of the lines 134 and 136 makes the hybrid coupler 120 substantially 100% compensating whereas the serpentine arrangement of the lines in the coupler shown in FIG. 5 makes it only about 80% compensating. However, the serpentine arrangement of the coupler shown in FIG. 5 will provide a smaller package than the rectangular arrangement since the same length of the lines can be achieved in a smaller area.

In the hybrid coupler 120, like the other forms of the coupler of the present invention, one-half of each of the lines is between the substrate surface and the dielectric layer and the other half of each line is over the dielectric layer. Thus, each lines is subjected to the same amount of the dielectric material so that the transit times of the two lines are substantially equal.

Figure 7:
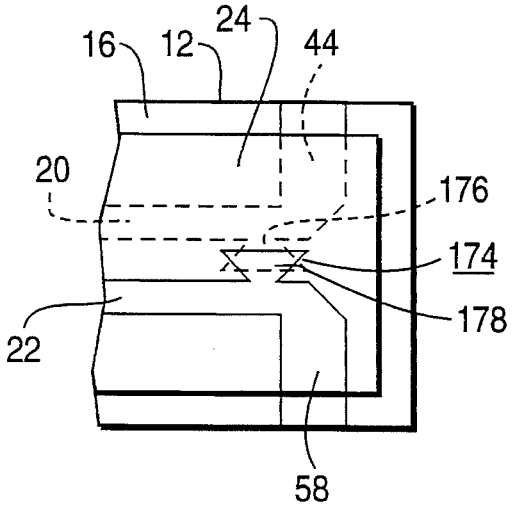
FIG. 7 is a top plan view of a portion of any one of the forms of the hybrid coupler of the present invention showing a form of a modification of the coupler.

Referring to FIG. 7, there is shown a modification of the hybrid coupler of the present invention. Although this modification can be used with any of the forms of the couplers shown in FIGS. 1, 5 and 6, it will be described being used with the coupler 10 shown in FIG. 1. The modification is a variable capacitor 174 which can be provided between the first and second transmission lines 20 and 22 adjacent the port ends 44 and 58. The capacitor 174 comprises a first truncated triangular electrode 176 extending from the first line 20 over the substrate surface 16 and toward the second line 22, and a second truncated triangular electrode 178 extending from the second line 22 over the dielectric layer 24 and over the first electrode 176. The electrodes 176 and 178 are both of the same conductive material as the lines 20 and 22. If the lines 20 and 22 are moved toward or away from each other as a result of misalignment of the masks forming the lines, the electrodes 176 and 178 will also move toward or away from each other. This movement of the electrodes 176 and 178 will vary the capacitance of the capacitor 174 so as to compensate for the variation in the spacing between the lines 20 and 22.

Figure 8:
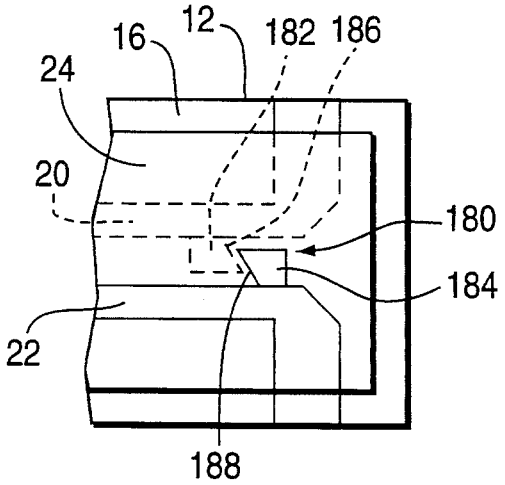
FIG. 8 is a top plan view similar to FIG. 7 showing another form of the modification.

Referring to FIG. 8, another form of the capacitor of the present invention which can be used with the hybrid couplers of the present invention is generally designated as 180. Capacitor 180 comprises a first electrode 182 on the substrate surface 16 and extending from the first line 20 toward the second line 22 and a second electrode 184 extending over the dielectric layer 24 from the second line 22 toward the first line 20. Each of the electrodes 182 and 184 is in the shape of a truncated right triangle with the smaller ends being at their respective transmission lines. The hypotenuse side 186 and 188 of the electrodes 182 and 184 respectively face and are opposed to each other. In the hybrid coupler having the capacitor 180, if the lines 20 and 22 are moved toward or away from each other when they are made, the hypotenuse sides 186 and 188 of the electrodes 182 and 184 are moved toward or away from each other so as to vary the capacitance of the capacitor 180. Thus, variations in the spacing between the transmission lines 20 and 22 are compensated for by variations in the capacitor 180.

Thus there is provided by the present invention a hybrid coupler in which the inlet ports of the two lines are at the same side of the substrate and the outlet ports of the two lines are at the same side of the substrate for ease of connecting the lines to other components with which the coupler is used. However, the two lines of the coupler are arranged so that they are both subjected to substantially the same amount of dielectric material so that the two lines have substantially equal transit times. Also, the two lines of the coupler can be arranged in either a serpentine or rectangular arrangement so that variations in spacing between the lines as a result of misalignment of the masks used to form the lines is compensated for. Furthermore, the coupler can be provided with a variable capacitor which also compensates for variations in the spacing between the lines.

What is claimed is:

1. A hybrid coupler comprising:

a substrate of an insulating material having first and second opposed surfaces, side edges and end edges;

first and second crossed conductive transmission lines over the first substrate surface;

a layer of a dielectric material over the first substrate surface;

each of said transmission lines having a first portion between the dielectric layer and the first substrate surface, a second portion over the dielectric layer and a connecting portion connecting the first and second portions of the line;

a port at the end of each portion of each of the transmission lines which is away from the connecting portion; and a conductive ground plane on the second surface of the substrate.

2. A hybrid coupler in accordance with claim 1 further comprising a protection layer of an insulating material over the dielectric layer and the transmission lines.

3. A hybrid coupler in accordance with claim 1 in which the first portion of the first transmission line and the second portion of the second transmission line extends along closely spaced, substantially parallel paths, and the second portion of the first transmission line and the first portion of the first transmission line extend along closely spaced, substantially parallel paths.

4. A hybrid coupler in accordance with claim 3 in which the connecting portion of one of the lines is on the substrate surface and under the dielectric layer, and the connecting portion of the other line is on the dielectric layer and crosses over the connecting portion of the one line.

5. A hybrid coupler in accordance with claim 4 in which each of the connecting portions extends through a separate opening in the dielectric layer to electrically connect the portions of its respective line.

6. A hybrid coupler in accordance with claim 5 in which the ports of each of the first portions of each of the transmission lines are along the same edge of the substrate, and the ports of each of the second portions of each of the transmission lines are along the same edge of the substrate.

7. A hybrid coupler in accordance with claim 6 in which each portion of each of the transmission lines is a straight line with the first portion of each of the transmission lines being in alignment and the second portions of each of the transmission lines being in alignment.

8. A hybrid coupler in accordance with claim 6 in which each of the transmission lines extends along a serpentine path over the surface of the substrate.

9. A hybrid coupler in accordance with claim 6 in which each of the transmission lines extends along a rectangular path over the surface of the substrate.

10. A hybrid coupler in accordance with claim 9 in which all of the ports of the portions of the transmission lines are along the same edge of the substrate with the ports of the second portions of the two transmission lines being adjacent each other and between the ports of the first portions of the transmission lines.

11. A hybrid coupler in accordance with claim 1 including a capacitor between the two lines, the capacitance of which varies with a variation in the spacing between the two lines.

12. A hybrid coupler in accordance with claim 11 in which the capacitor comprises a separate conductive electrode extending from each of the lines with one electrode being on the substrate surface and under the dielectric layer and the other electrode being over the dielectric layer.

13. A hybrid coupler in accordance with claim 12 in which each of the electrodes is in the form of a truncated triangle with the smaller end being at its respective line.

14. A hybrid coupler in accordance with claim 13 in which the one electrode extends from a portion of one of the lines which is on the substrate surface and the other electrode extends from a portion of the other line which is adjacent the one line and which is on the dielectric layer.

15. A hybrid coupler in accordance with claim 14 in which the electrodes overlap each other.

16. A hybrid coupler in accordance with claim 14 in which each of the electrodes has an angles edge with the angled edges being adjacent and opposed to each other.

* * * * *